US005100350A

United States Patent [19]

Buzzi

[11] Patent Number: 5,100,350

[45] Date of Patent: Mar. 31, 1992

[54] DEVICE FOR REGULATING THE INCLINATION ANGLE OF A SURFACE PROPELLER SHAFT LINE AS TO THE WATER PLANE

[76] Inventor: Fabio Buzzi, Via per Lecco, 1, 22048 Oggiono, Italy

[21] Appl. No.: 674,189

[22] Filed: Mar. 25, 1991

[30] Foreign Application Priority Data

Apr. 6, 1990 [IT] Italy ..... 19956 A/90

[51] Int. Cl.[5] ..... B63H 5/12

[52] U.S. Cl. ..... 440/82; 440/83

[58] Field of Search ..... 440/49, 53, 56, 57, 440/64, 79, 82, 83

[56] References Cited

U.S. PATENT DOCUMENTS

| | | | |
|---|---|---|---|
| 1,473,832 | 11/1923 | Park . | |
| 1,490,046 | 4/1924 | Turnbull . | |
| 1,490,112 | 4/1924 | Johnson | 440/53 |
| 1,529,897 | 3/1925 | List | 440/82 |
| 2,415,183 | 2/1947 | Law . | |
| 2,521,368 | 9/1950 | Hingerty | 440/83 |
| 2,934,034 | 4/1960 | Grzesnikowski | 440/82 |
| 2,956,536 | 10/1960 | Kilvington . | |
| 3,428,017 | 2/1969 | Altson | 440/82 |
| 4,089,289 | 5/1978 | Sauder | 440/82 |

FOREIGN PATENT DOCUMENTS

| | | | |
|---|---|---|---|
| 468827 | 7/1914 | France | 440/53 |
| 612166 | 10/1926 | France . | |
| 701948 | 3/1931 | France . | |
| 775523 | 12/1934 | France . | |
| 326506 | 3/1930 | United Kingdom . | |
| 2061851 | 5/1981 | United Kingdom . | |

*Primary Examiner*—Jesûs D. Sotelo
*Assistant Examiner*—Stephen P. Avila
*Attorney, Agent, or Firm*—Oliff & Berridge

[57] ABSTRACT

The present invention relates to a regulating device which permits changing inclination angle of the shaft line of a propeller and comprises an at least partially spherical and revolving box containing the support bearings of the propeller shaft and two stands supporting the same propeller shaft and connected by slots and locking bolts.

3 Claims, 3 Drawing Sheets

DEVICE FOR REGULATING THE INCLINATION ANGLE OF A SURFACE PROPELLER SHAFT LINE AS TO THE WATER PLANE

FIELD OF THE INVENTION

The present invention relates to a regulating device which permits changing the angle of a speed-boat propeller shaft in relation to the water plane.

PRIOR ART

It is known that with fast planing hulls with surface propeller transmission it is extremely important to determine the appropriate position of the propeller in relation to the water line.

Indeed this position is difficult to calculate since the inclination angle of the water flow at the outlet of the stern board is a function of many factors including weight, speed, hull shapes, etc.

Previous solutions have all been of two types: fixed transmissions wherein a different height of the supporting stand required days of work in the shipyard to modify the alignment and motor supports, or mobile transmissions of the stern drive type or the American Arnesons where the shaft is displaced at will by a hydraulic piston controlled by the pilot.

But the latter systems have some limitations because they cause phenoma of directional instability.

SUMMARY OF THE INVENTION

The object of the present invention is a device for quickly and accurately regulating the inclination angle of the propeller shaft line and which could be applicable to a fixed transmission.

The device in accordance with the invention is characterized in that it comprises first and second support means of the propeller shaft, said first support means consisting of an at least partially spherical box adapted for containing at least one support bearing for said shaft and of metal rings with at least partially spherical seats in which is mounted said box and having fastening means to the structure of the speed-boat, said second support means consisting of a fixed stand connectible to said structure and an adjustable stand having a supporting bush for said shaft, said stands having at least one slot and at least a hole for one bolt adapted to engage with said slot to firmly connect said stands in the relative position selected to obtain the desired inclination angle of the propeller shaft.

Preferably said at least one slot is arcuate and is virtually right-angled to a line joining the hole for said bolt with the centre of said spherical box.

DETAILED DESCRIPTION OF THE INVENTION

The characteristics and advantages of the invention will be explained with reference to annexed FIGS. 1 to 3 in which is shown as a nonlimiting example a preferred embodiment of said invention.

Figure 1:
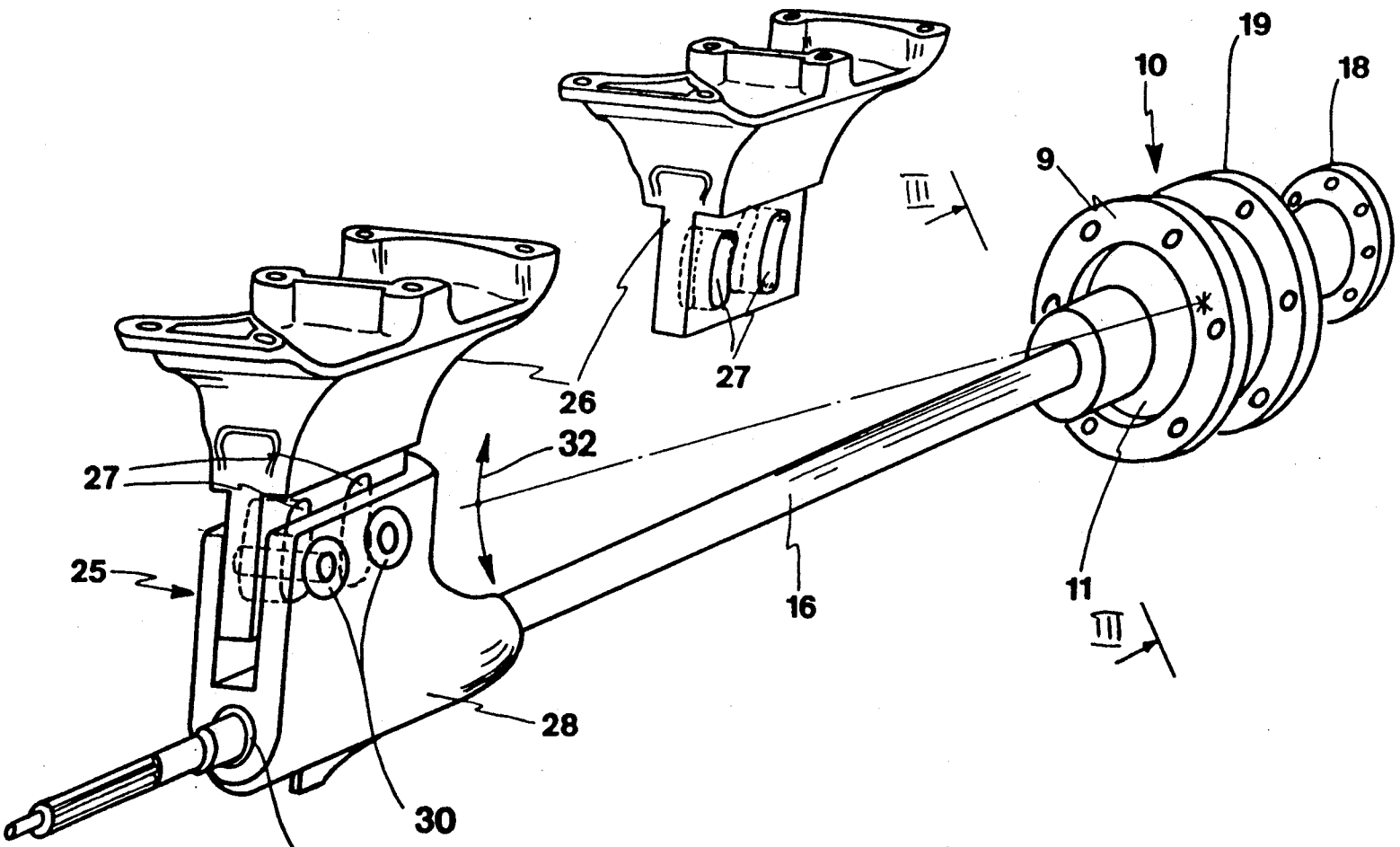
FIG. 1 shows a perspective view of the regulating device in accordance with the invention.

The device in accordance with the invention comprises first support means, indicated as a whole by reference number 10, consisting of a partially spherical box 11 in two half-shells 11*a* and 11*b* containing two appropriately lubricated thrust bearings 12 which support the sleeve 13 with which the shaft 16 of the propeller of a speed-boat (not shown) is firmly connected by means of a key 14 and nut 15. The sleeve 13 has a flange 18 for connection to a universal joint which is in turn connected to the motor shaft (not shown). The partially spherical box 11 is mounted in metal rings 19 with partially spherical seats 20 which are constrained by bolts 21 and 21*a* to a plate 22 fixed to the stern structure 33 of the speed-boat.

By loosening the bolts 21 it is possible to change the position of the spherical box 11 and regulate the inclination angle of the shaft 16 as shown by the arrow 32. Reference number 23 indicates a rubber seal placed between the shaft 16 and the box 11.

Figure 2:
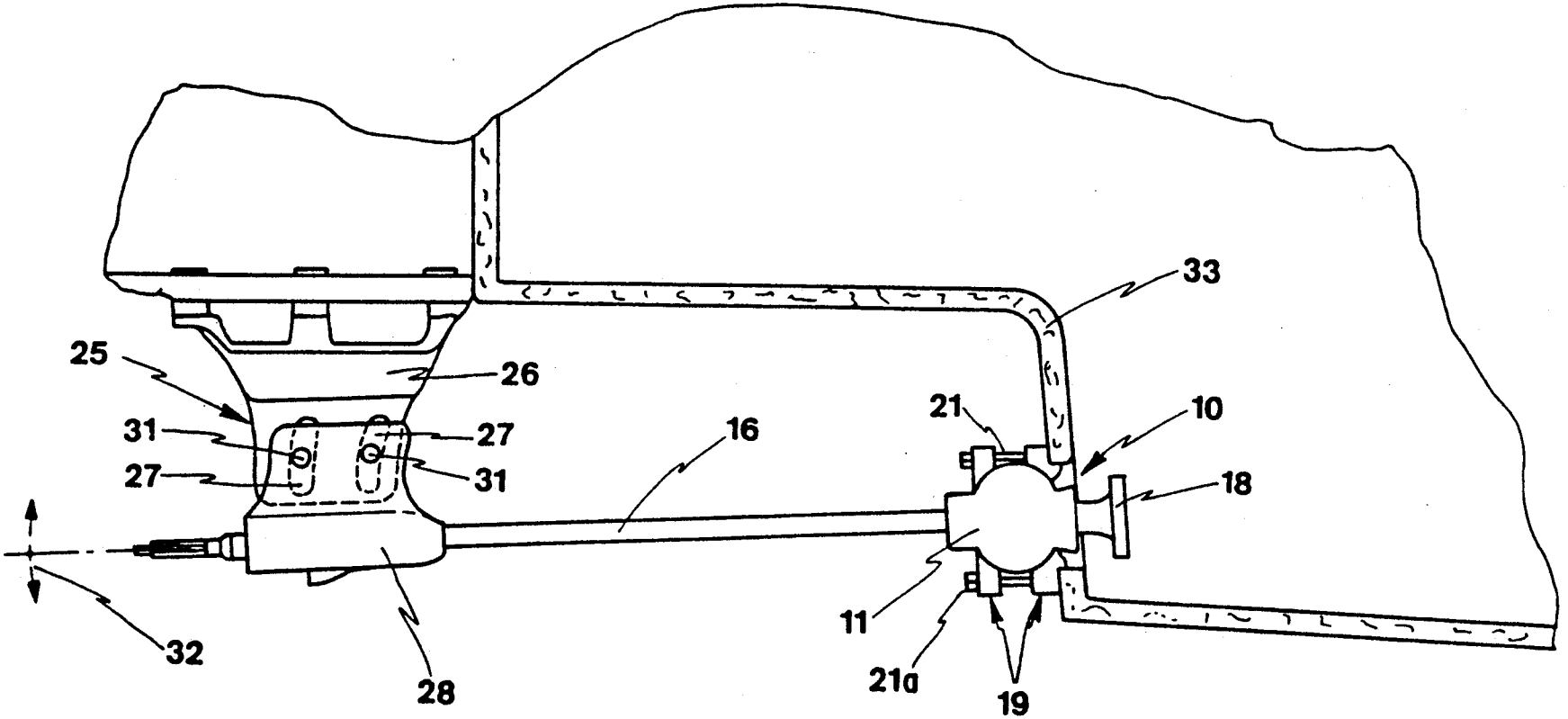
FIG. 2 shows a side view of the device of FIG. 1.
Figure 3:
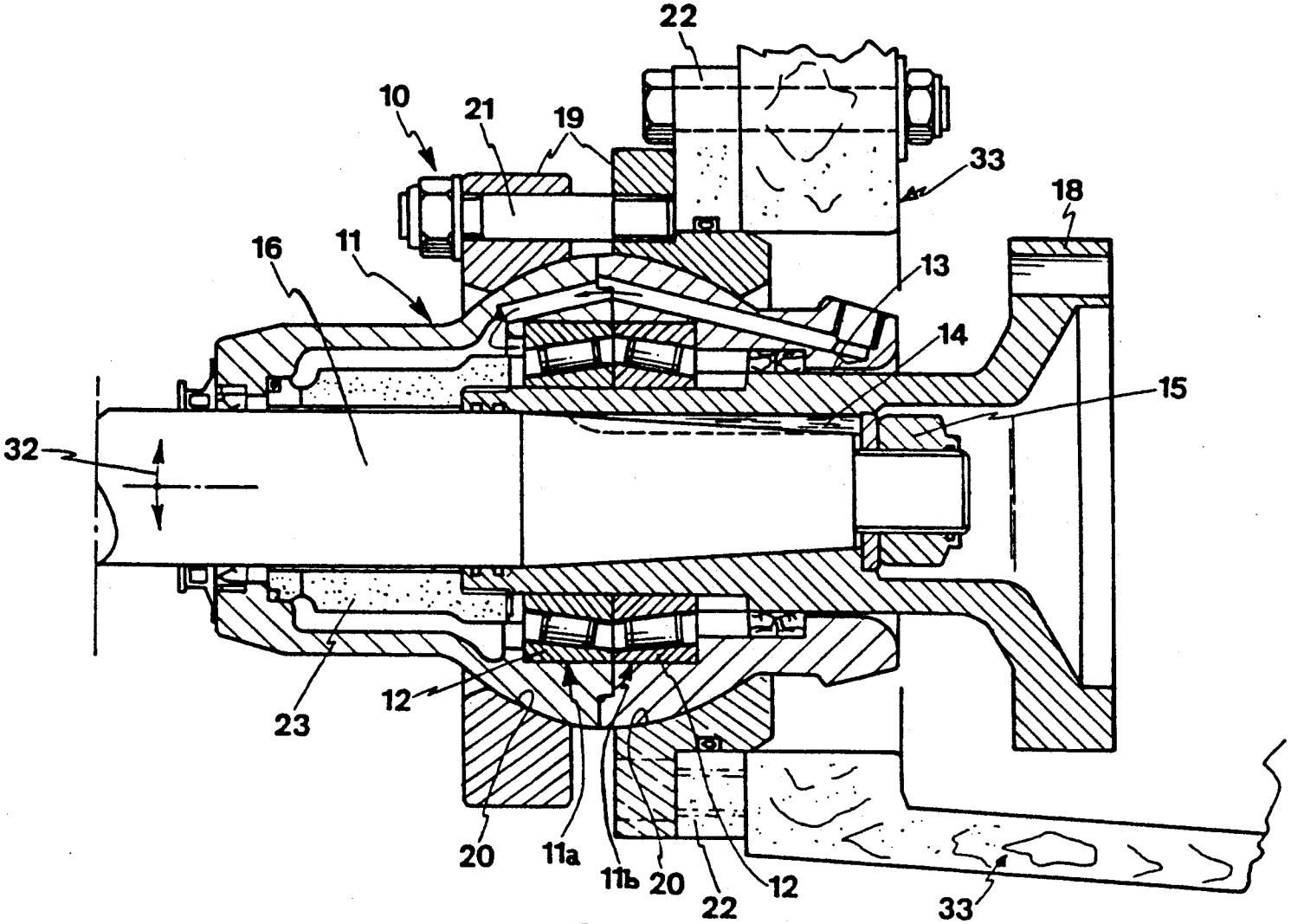
FIG. 3 is a partial cross-section view taken along the line III—III of FIG. 1.

The device comprises second support means indicated as a whole by reference number 25 and consisting of a fixed stand 26 and an adjustable stand 28. The stand 26 is firmly connected with said structure 33 as shown in FIG. 2 and has two slots or arcuate oval holes 27 having a direction virtually at a right angle to a line passing through the holes 30 of the stand 28 and the centre of the spherical box 11. The shaft 16 of the propeller is mounted in the adjustable stand 28 by means of a rubber supporting bush 29. The stand 28 has through holes 30 which house the bolts 31 which are adapted to engage with the slots 27 to connect firmly the two stands 26 and 28 in the relative position selected to achieve the desired inclination angle of the shaft 16.

The slots 27 allow a few centimeters of movement of the adjustable stand 28, which is sufficient to suitably accurately regulate the height of the propeller as to the dynamic water line. By tightening the bolts 31 the stand 28 is fixed in the desired position as to the stand 26.

It is pointed out that the further advantage of this system is that the rubber bush 29 supporting the shaft 16 contained in the adjustable stand 28 is self-aligning with the shaft line which is supported correctly on the entire length of said bush.

I claim:

1. A device for regulating the inclination angle of a propeller shaft of a speed-boat comprising:

first and second support means for supporting first and second portions, respectively, of the propeller shaft, said first support means including an at least partially spherical box adapted for containing at least one support bearing for said first portion of said propeller shaft and metal rings with at least partially spherical seats in which is mounted said box to restrain said at least partially spherical box and said propeller shaft from movement in an axial direction along said propeller shaft, and having fastening means fixed to the structure of the speed-boat for selectively varying the inclination angle of the propeller shaft and maintaining the inclination angle at said first portion of said propeller shaft, said second support means including a fixed stand connectable to said structure and an adjustable stand having a supporting bush for said shaft, said stands having at least one slot and at least a hole for one bolt adapted to engage with said slot to firmly connect said stands in the relative position selected to obtain the desired inclination angle of the propeller shaft.

2. The device in accordance with claim 1, wherein said at least one slot is arcuate and has a virtually right angle direction relative to a line joining the hole for said bolt with the centre of the spherical box.

3. The device in accordance with claim 1, wherein said fixed stand has two slots and said adjustable stand has two holes for two bolts adapted to engage with said slots.

* * * * *